US005361749A

United States Patent [19]

Smith et al.

[11] Patent Number: 5,361,749

[45] Date of Patent: Nov. 8, 1994

[54] GAS FIRED CONVECTION OVEN

[75] Inventors: Mark Jr. Smith, Fuquay-Varina; Gajanan M. Prabhu, Cary, both of N.C.

[73] Assignee: Southbend, Fuquay-Varina, N.C.

[21] Appl. No.: 979,203

[22] Filed: Nov. 20, 1992

Related U.S. Application Data

[63] Continuation-in-part of Ser. No. 833,889, Feb. 10, 1982, abandoned, which is a continuation of Ser. No. 145,293, Oct. 29, 1993.

[51] Int. Cl.[5] ..... A21B 1/00

[52] U.S. Cl. ..... 126/21 A; 126/21 R; 126/19 R; 126/273 R; 432/176

[58] Field of Search ..... 126/21 R, 21 A, 19 R, 126/39 R, 273 R, 275 R, 110 R, 101; 431/354, 286, 353; 432/176, 199

[56] References Cited

U.S. PATENT DOCUMENTS

| | | | |
|---|---|---|---|
| 3,831,579 | 8/1974 | Tamada et al. | 126/21 A |
| 4,336,789 | 6/1982 | Ogawa | 126/21 A |
| 4,516,012 | 5/1985 | Smith et al. | 219/400 |
| 4,601,279 | 7/1986 | Guerin | 126/21 A |
| 4,757,800 | 7/1988 | Shei et al. | 126/21 A |
| 5,035,609 | 7/1991 | Riehl | 431/286 |
| 5,076,494 | 12/1991 | Ripka | 237/19 |
| 5,125,390 | 6/1992 | Riehl | 126/39 R |

FOREIGN PATENT DOCUMENTS

| | | | |
|---|---|---|---|
| 88541 | 5/1983 | Japan | 126/21 A |
| 136921 | 8/1983 | Japan | 126/21 A |
| 782678 | 9/1957 | United Kingdom | 126/21 A |

*Primary Examiner*—Larry Jones

*Attorney, Agent, or Firm*—Laff, Whitesel, Conte & Saret

[57] ABSTRACT

A convection oven is given a lower profile so that two ovens may be stacked without exceeding a height so that the uppermost of the stacked ovens may be comfortably reached by a relatively short person. Also, the oven requires less floor space for installation and operation. The height of the oven is reduced by placing in-shot burners at an inlet to the oven. Heretofore, the burners were placed under the oven, which increased the space which must be provided to enclose the burner, and therefore the overall height of the burner. The height of the oven is reduced by allowing the flue gas flow from front to rear before entering the cooking cavity. Heretofore, the flue gas flowed from under the cooking cavity to the sides and up towards the top of the cooking cavity. From there, it traveled to the top of the cooking cavity before entering the cooking cavity itself. Cool ambient air is blown over oven controls in order to cool them before the air is heated by the burners.

15 Claims, 4 Drawing Sheets

GAS FIRED CONVECTION OVEN

CROSS-REFERENCE TO RELATED APPLICATIONS

This application is a continuation-in-part of application Ser. No. 07/833,889, filed Feb. 10, 1992, abandoned and replaced by a continuation application Ser. No. 08/145,293, filed Oct. 29, 1993.

BACKGROUND OF THE INVENTION

This invention relates to new and improved convection ovens and more particularly to convection ovens with improved burners for establishing a lower profile and a better air flow pattern.

Many current convection ovens use burners made of an elongated horizontal tube or tubes made of sheet metal or cast iron. Usually both of these types of burners require a relatively tall combustion chamber for two reasons. First, there must be enough space inside the combustion chamber for flames to rise vertically above the burner without damage to overlaying structures. Second, there must be enough space within the combustion chamber to house the elongated burner which may extend throughout the entire length or depth of the oven.

Because of the cost, size and mode of operation, tubular burners are usually located within a combustion chamber below a baking cavity within the oven. This location necessarily causes the burner skin temperature to increase to such a degree that the life of a sheet metal burner may be shortened. There may also be an adverse effect upon the bottom wall of the oven itself. Cast iron burners are more durable than sheet metal burners. However, they are also more expensive than sheet metal burners, and so make the oven more expensive for the consumer to buy.

The tubular type of burner also has a substantial effect upon the overall height of the oven which must be correspondingly tall in order to contain the relatively tall combustion chamber, especially with the need for flame space above the burner. That resulting large size of the oven not only adds to its cost, but also means that when one oven is stacked on top of another, the top oven may be too high for some people to easily reach in.

DESCRIPTION OF THE PRIOR ART

Three examples of prior convection ovens are found in U.S. Pat. Nos. 4,516,012 (Smith et al.); 4,867,132 (Yencha); and 4,928,663 (Nevin et al.). Among other things, the differences between the inventive oven and the Smith et al. (U.S. Pat. No. 4,516,012) oven and the Nevin et al. oven (U.S. Pat. No. 4,928,663) are that, in the prior art ovens, the flue gas products are wiped around the outside of the oven cavity before being pulled into and after its exit from the oven cavity. Also, the inventive oven contains an inshot burner which does not require substantial flame space above it. The inventive oven is also different from Nevin et al. (U.S. Pat. No. 4,928,663) because the impeller or blower wheel construction differs from the Nevin et al. impeller or blower wheel. Unlike the Smith et al. (U.S. Pat. No. 4,516,012) oven and Nevin et al. oven (U.S. Pat. No. 4,928,663), this improved flue gas flow allows for a reduced overall width of the inventive oven and overall height of the inventive oven by doing away with flue gas passageways on two sides and above the cooking cavity. The Yencha (U.S. Pat. No. 4,867,132) oven has the burner in the back and not under the oven.

There are a number of other considerations that go into the design of an oven. For one thing, the oven requires controls which usually cannot tolerate the heat (or at least the maximum heat) of the oven. Therefore, these controls must be protected from the overheat. Another problem is that, for maintenance and convenience of servicing, these controls should be accessible from the front of the oven, without requiring either any movement of the oven or a maintenance access space around the oven.

This need for cooling and for front servicing leads to secondary problems. First, a location of burners in the front of the oven creates heat in the area where the controls should be located. Also, the intake of combustion air required by the burners leads to open spaces (usually covered by louvers or the like) in the front of the oven. If the ovens are stacked, as intended with this oven, the bottom oven will very likely have its air intakes very close to the floor. The custom in many restaurants is to hose down the floor, which leads to a spray of water being deflected in random directions. As a result, water enters the oven via the air intake louvers. This causes pilot flame outages, electrical short circuits, premature failure of oven parts, and down time while the ovens cannot be used. Thus, an attractive design will have means for pulling cool air into the front of the oven without exposing the interior of the oven to ambient water.

Accordingly, an object of the invention is to increase the burner life. A more particular object is to provide a burner which is used to heat the oven, while the burner itself remains outside of the combustion chamber thereby extending the burner's life.

Another object of the invention is to reduce the height of the oven. In particular, the object is to reduce the height of the oven by reducing the height of the combustion chamber and by reducing the space above the cooking cavity. Here, the object is to place the stacked oven in a double deck configuration at a convenient height for the workers, and especially for the shorter workers.

Yet another object of this invention is to reduce the width of the oven. In particular, the object is to reduce the width of the oven by improving the flue gas flow. Here the object is to reduce the floor space requirement in a kitchen for oven installation and operation.

Still another object of the invention is to reduce the overall oven height. Here an object is to make an uppermost one of stacked ovens low enough so that it is easier for people to work with them.

A still further object of the invention is to place all controls on the front of the oven. Here an object is to bathe these controls with cooling air. In particular, an object is to accomplish these objects without simultaneously providing open spaces through which water may enter the oven.

These objects are possible because there is no tubular burner which must extend throughout the inside length or depth of the oven. Its absence allows the combustion chamber height to be reduced partially by the diameter, flame height, and perhaps more, of the old tubular burner.

In keeping with one aspect of this invention, an inshot burner is positioned outside a heating chamber. When it is ignited, its flame projects into the heating chamber. A bi-centrifugal blower, or any suitable air movement device, such as a blower or impeller, pulls cool ambient air into the back of the oven, over the controls, and onto the burner. The resulting flue gases pass through a passageway under and in the rear of the oven cavity, into the cooking cavity and also forces some of the heated air to circulate within the inside of the cooking cavity, and then out a flue gas passageway at the top of the oven.

BRIEF DESCRIPTION OF THE DRAWINGS

A preferred embodiment of this invention is shown in the drawings, in which.

DESCRIPTION OF THE PREFERRED EMBODIMENT

Figure 1:
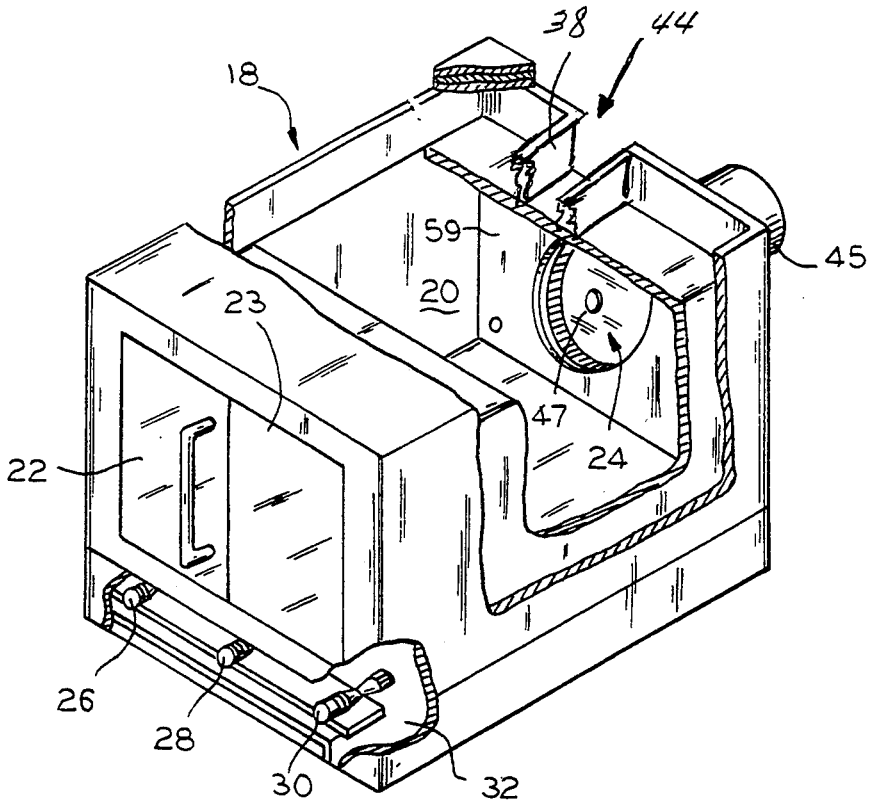
FIG. 1 is a perspective view of one embodiment of a convection oven, with parts of the outer and oven cavity walls cut away to reveal internal oven parts.
Figure 2:
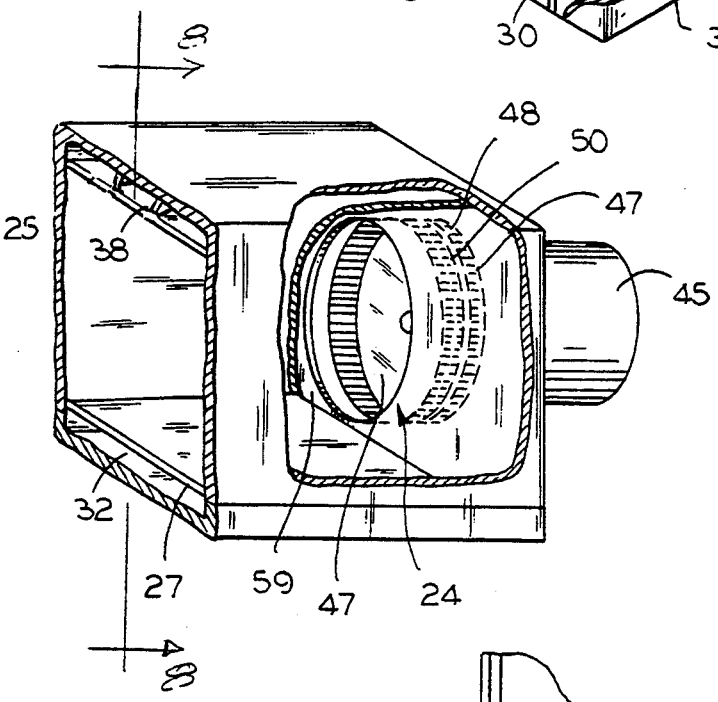
FIG. 2 is a perspective view partially cut away to show a bi-centrifugal blower.

As shown in FIG. 1, a low profile oven 18 comprises an insulated housing, defining a baking cavity 20 with two front access doors 22, 23 on one side and a blower 24 on an opposite (back) side. The oven housing may take any convenient form, shape, and size. It may have interior and exterior metal surfaces separated by suitable insulation.

Figure 8:
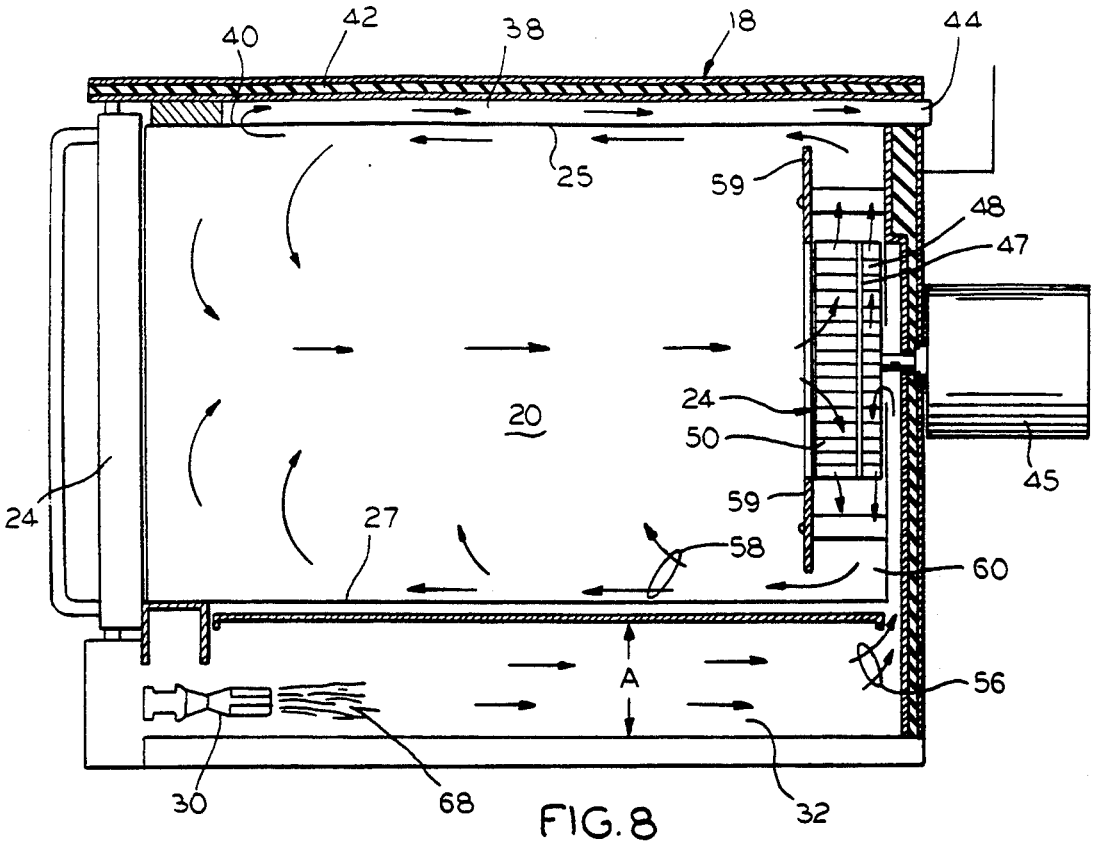
FIG. 8 is a cross sectional view showing the air circulation pattern within the oven.

In greater detail, in one embodiment, the oven comprises an insulated enclosure housing 18 with a central baking area 20 defined on at least two sides by non-insulated walls 25, 27 (FIG. 8). On these two sides, channels 32, 38 form air passageways outside of the non-insulated walls. A first 32 of the channels is a combustion chamber formed under the floor of the oven cavity 20. A second 38 of the channels is an exhaust formed over the ceiling of the oven cavity 20. Each of these channels 32, 38 has an opening to ambient external air for drawing air into and expelling air from the oven cavity. The front of the exhaust passageway 38 opens into the baking cavity at inlet 40 (FIG. 8) and ends in the back of the oven at an outlet port 44. The blower 24 draws in air through one of the channels 32, circulates air within the oven, and blows air out through the other 38 of the channels. Inshot burners 26, 28, 30, at the front of the oven heat the air inside the first channel or combustion chamber 32.

The circulating air motor 45 is located outside the insulated housing of the oven cavity. Motor 45 drives bi-centrifugal blower 24, and circulates air within the oven and into exhaust passageway 38 through the outlet 40 to the ambient air through the outlet port 44.

The blower 24 comprises a rotating cylinder with a solid plate 47 in a central region. Blades 48 on rear side of the solid plate 47 draw ambient external air past the burner means 26, 28, 30 and into the oven chamber. Blades 50 on the front side of the solid plate 47 circulate air within the oven and expel it from the oven via channel 38. As the blower wheel rotates, a centrifugal force flings air outwardly from the periphery of the two sets of blades 48, 50, while drawing air into the center of the blades. The solid disk 47 separates these two air streams.

Hence, there are two separate air streams 56, 58 (FIG. 8), separated by a solid plate 47, one stream 56 entering the back of blower blades 48 and the other 58 entering the front blower blades 50. Air stream 58 is a recirculation of air within the oven cavity 20. Air stream 56 is the hot air that is heated by the burners 26–30. These two streams 56, 58 mix at the outlets of the two sets of blower blades.

The blower 24 is located behind a baffle plate 59 which separates the oven cavity into two compartments, one including blower 24 the other forming the oven baking cavity 20. The space surrounding baffle plate 59 and a hole through the center of baffle plate 59 provide a path through which the heated air may flow under the urging of the blower. The first or central opening provides a path for the passage of air from an interior of the oven to the blower. The baffle means 59 is surrounded by space between it and the oven walls. This space forms openings through which circulating air is expelled into the oven. Hence, the baffle plate 59 forces the air to flow around the sides of the oven and to return to the blower through the center of the oven. This flow creates a substantially uniform temperature throughout the oven cavity 20.

The oven area is heated from the draft 56 of hot air flowing through channel 32. More particularly, the blades 48 draw in a constant inflow of fresh air 56 which has been heated by the burners 26, 28, 30. This inflow forces an equal amount of internal oven air out the port 40 and through channel 38 over the top of the oven to exit port 44. This draft of air tends to prevent cooling air from entering the oven via port 44 and thus retains the heat in the oven.

Figure 9:
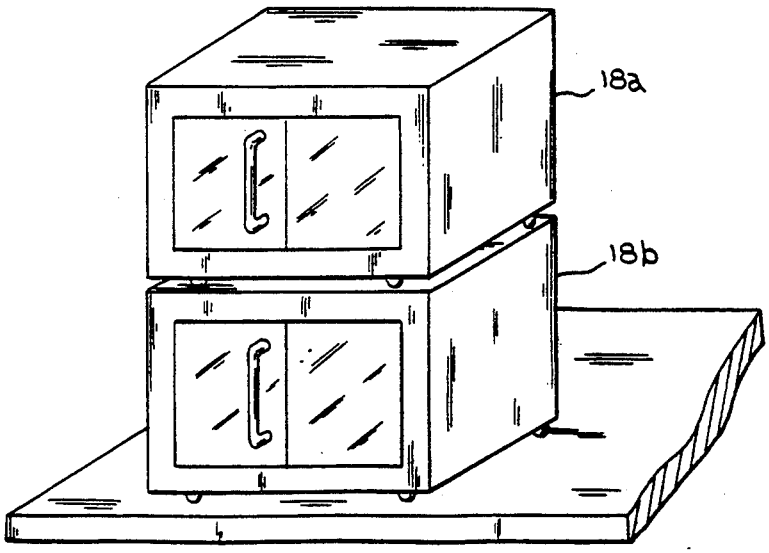
FIG. 9 shows two of the inventive ovens stacked one above the other.

Means are provided for maintaining the inshot burners 26, 28, 30 from the front of the oven since they are positioned at the front of the combustion chamber 32. By this, the overall height of the oven is reduced since the burners are not enclosed within a space below the oven cavity. In the prior art, these burners were often at the back of the oven or were under the oven. Among other things, when under the oven, a direct contact between a burner flame and the bottom surface 27 of the oven cavity 20 would soon warp, damage or destroy the oven. Therefore, when under the oven, the flame had to be far enough below the surface 27 to preclude such damage, which required a substantial height, at A. The invention greatly reduces this height. Thus, as shown in FIG. 9, the invention provides for a plurality of stackable, low profile ovens, with the burner means heating the air at an entrance of —not within—the combustion chamber 32.

Figure 3:
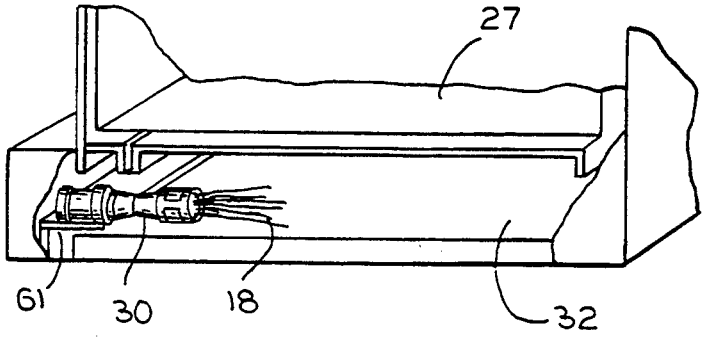
FIG. 3 is a perspective view, partially in cross section, to show an inshot burner in the new convection oven.

In keeping with one aspect of this invention, the traditional combustion tubular or cast iron burner is replaced by one or more modular inshot burners 26–30 (FIGS. 4–7). The inshot burners are located at a front of said oven for easy servicing and maintenance (FIGS. 1, 3, 8). Any suitable modules which are standard commercial items may be used. One suitable module is made by the Robertshaw Controls Company, New Stanton Division. Another supplier of suitable modules is Burner Systems International, Inc.

A transverse channel shaped support member 61 extends under and across the three burner modules. Each module is cradled in a concave shape 63 and secured in place by two screws 65, 67. The downwardly directed members of channel 61 rest on the floor of combustion chamber 32 and support the burners 26–30 in an elevated position.

Each of these modular burners has a somewhat cylindrical configuration and clips together with other modules to form an array of burners, in a horizontal row. These cylindrical members have somewhat wing-like projections 69 which provide means for feeding gas into adjacent modules as a pilot or lighting flame. A flame shaping means is located at the inner end of the cylindrical member to project a flame 68 into the combustion chamber or intake air channel 32. This flame 68 (FIG. 3) is somewhat reminiscent of a blowtorch flame. The heat from the flame is projected throughout the combustion chamber 32 and upwardly at 56 (FIG. 8) through the blower and into the oven area 20.

Figures 4, 5, 6, 7:
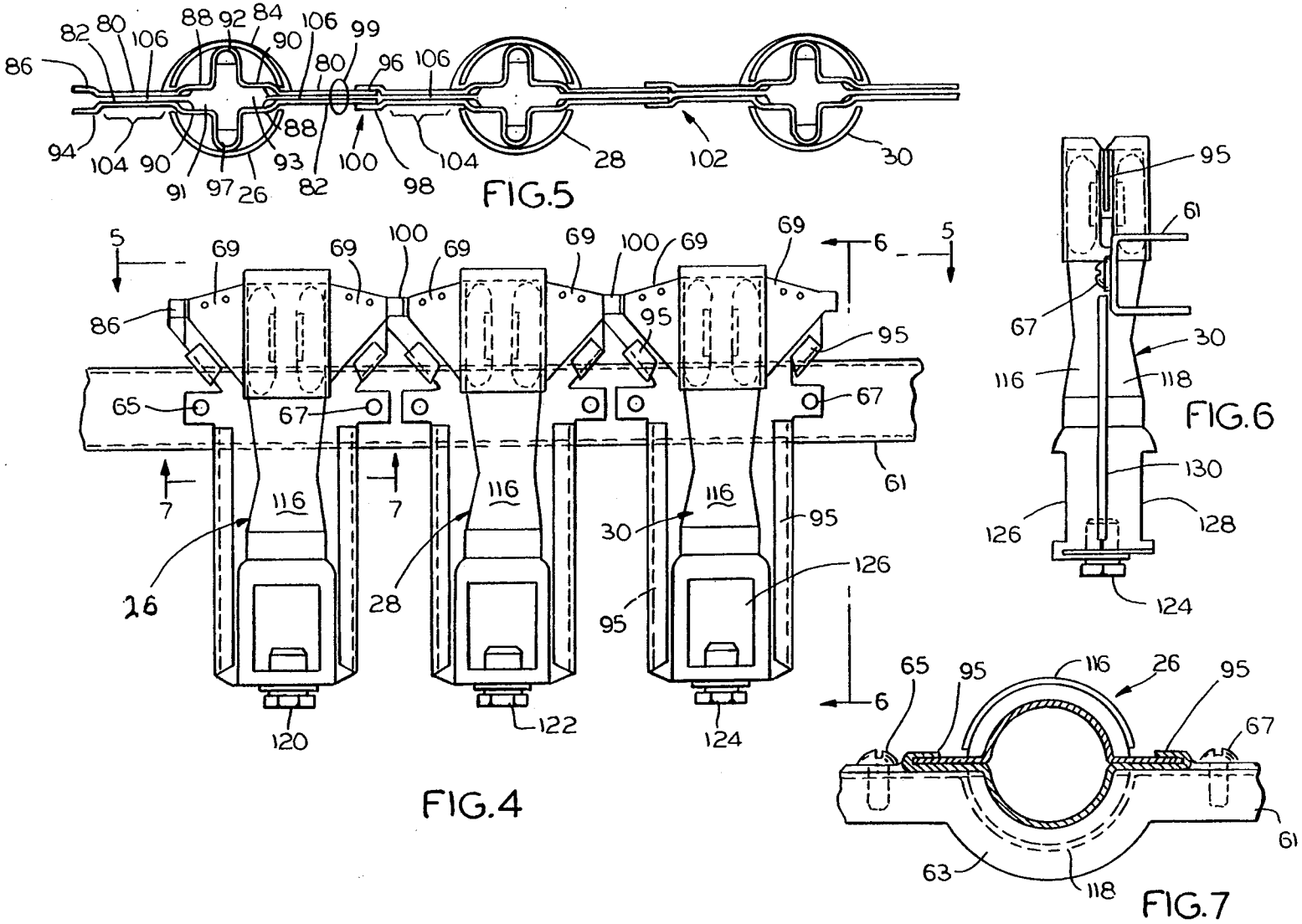
FIG. 4 is a top plan view of the inshot burners.
FIG. 5 is an end view of the inshot burner taken along line 5—5 of FIG. 4.
FIG. 6 is a side elevation of the inshot burner taken along line 6—6 of FIG. 4.
FIG. 7 is a cross sectional view taken along line 7—7 of FIG. 4.

The construction of the inshot burners 26–30 is best seen in FIGS. 4–6. The burner is made of sheet metal, and therefore preserves the desirable low cost. However, since it is outside chamber 32, it remains cooler and the sheet metal does not discolor, warp, disintegrate or otherwise become damaged by the heat.

The in-shot burners are located in a horizontal row to project a plurality of horizontal flames into the first channel 32, which extends across substantially the full width of the oven. By way of example, modular burner 30 (FIGS. 5, 6) is made from two mirror image stamped metal plates 80, 82, surrounded by a somewhat cylindrical member 84. One of the stamped metal plates 80 begins with a step 86, followed by a substantially flat member 87 and then half 88 of a horizontal flame shaping channel 91 which is completed by a complementary shape 90 formed on plate 82. Thereafter plate 80 has a second and vertical flame shaping channel 92, followed by its half 90 of the horizontal channel 93 completed by shape 88 on plate 82. Thus, there are four substantially U-shaped members 91, 92, 93, 97, which together will tend to shape the flame in a known manner.

The other plate 82 is a mirror image of plate 80. Metal parts are crimped together as at 95. When those two plates are joined together in a face-to-face contact, the two steps 86, 94 form the open arms of a U-shaped member for receiving a tab 99 formed by the two flat face-to-face ends 96, 98 on the opposite ends of the two wing-like plates 80, 82. Therefore, as shown at 100, 102, the three modules 26, 28, 30 are formed by slipping the tabs 96, 98 on one end of wing-like plates 80, 82 into the U-shaped member 86, 94 on the opposite end of the plates. In the flat areas such as 104, the two plates 80, 82 are separated by a narrow space which provide a continuous gas carry over channel 106 for conveying lighting gas to adjacent burners. The interlocking feature of tabs 96, 98 and U-shaped members 86, 94 thus enable the modules to snap together.

The generally cylindrical shroud, 116, 118, is given a shaped waist of reduced its cross section which enhances the burner efficiency. An orifice hood 120, 122, 124 is placed in the end of the cylindrical shroud 116, 118 to receive gas from a manifold leading to a connecting gas line (not shown) and to provide an orifice for emitting gas into an area having upper and lower windows 126, 128 (FIG. 6) for admitting combustion air. A gas stream is projected forward of the orifice in the orifice hood, past windows 126, 128, and through the waist of reduced cross section at the center of the cylindrical shroud. The high velocity gas jet streaming from the orifice pulls in combustion air through the windows 126, 128. The gas and combustion air mix homogeneously as they pass through the diverging part of cylindrical shroud downstream of the reduced cross section. At the far end of the waist, the projected gas-air mixture reaches the flame shaping members 88–92.

If, for any reason, flames are burning at one or more of the burners and no flame is burning at another burner, the gas passageway 106 at the flat positions 104, extending through the connectors 100 act as a channel for pilot lighting gas to re-ignite the burner which is out.

Thus, as shown in FIG. 8, substantially none of the height A is devoted to housing a burner, per se. Moreover, there is no need to provide a clearance above the flame of the non-existing burner. The only space that is required is devoted to the passage of a stream of hot air and to those special needs that are required to build the assembly and to provide a workable device.

A second embodiment of the invention maintains a stream of cooling air across oven controls. Also, this embodiment has no air intake open spaces in the front of the oven where water may enter the oven during a hosedown or other time when water is present.

Figure 11:
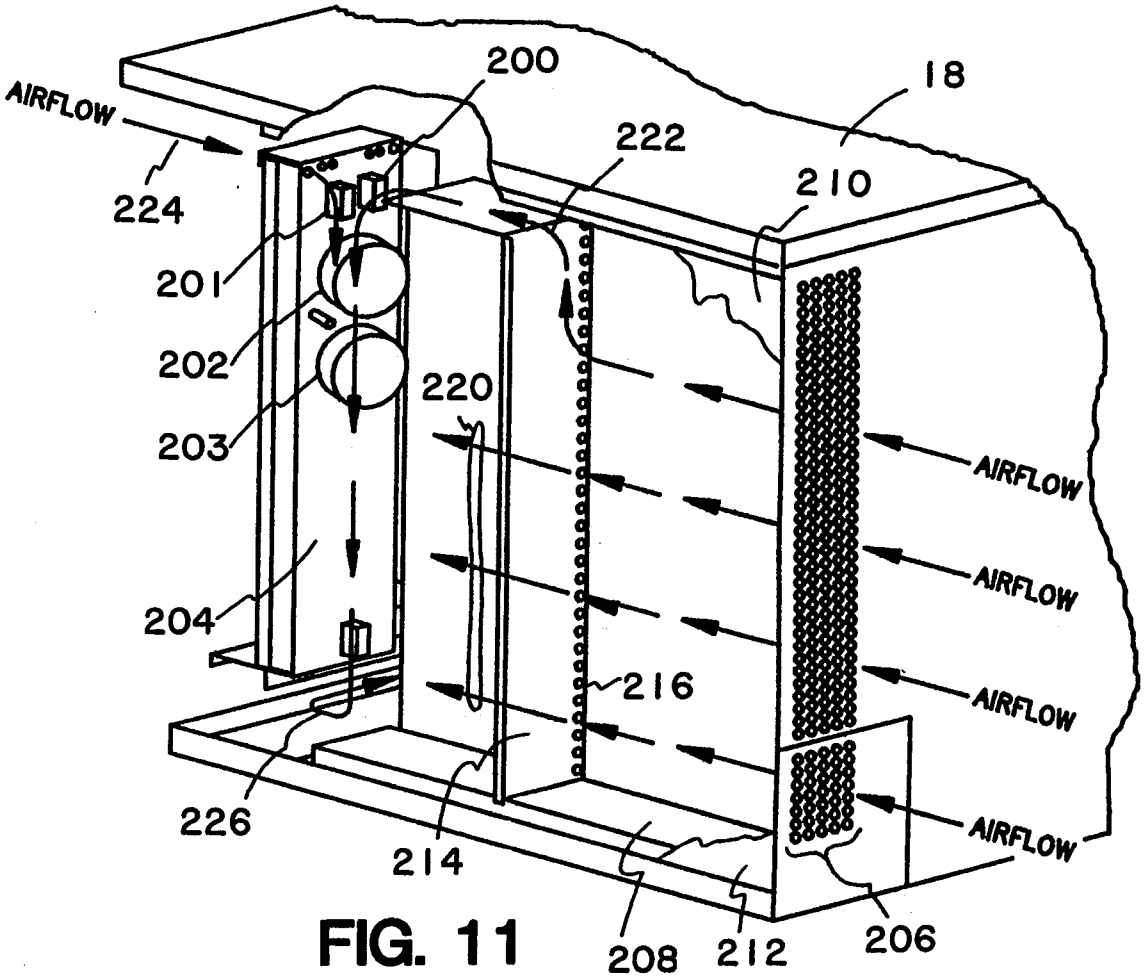
FIG. 11 is a partially cut away view, in perspective, especially for showing an air flow path for cooling the control panel.
Figure 10:
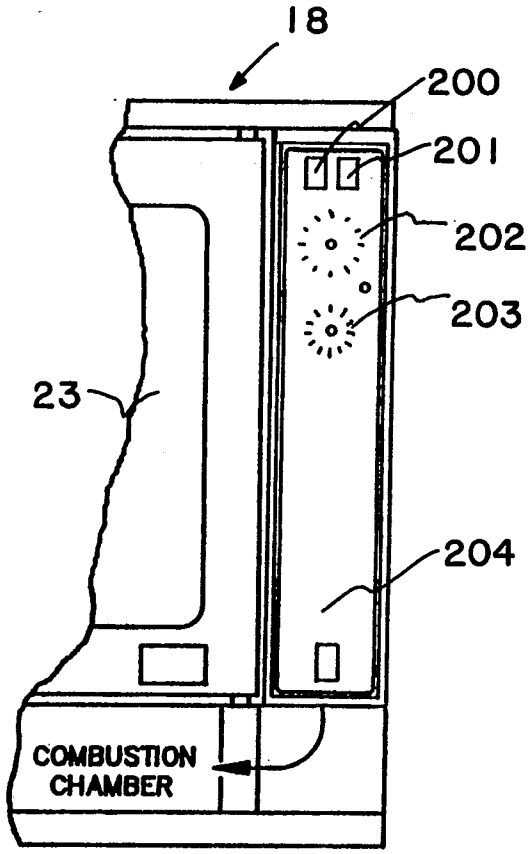
FIG. 10 is a front elevation showing the location of a control panel.

In greater detail, the controls 200–203 (FIGS. 10, 11) are mounted on a panel 204 on one side of the front access door 23. The particular functions of the controls are irrelevant. They may adjust temperature, provide a timed cooking cycle, etc. The point is that the controls may include components which cannot be exposed to heat. For example, these controls may include semiconductor devices, microprocessors, etc.

The back of the oven 18 has a number of air intake openings 206 (FIG. 11) through which ambient air may enter, under the urging of the blower 24. The cool entering air passes through a duct 208 formed between one side of the oven cavity 20 and an outside oven wall shown broken away at 210 and 212.

The inside of duct 208 is blocked by an air flow splitter panel 214 which has a number of holes 216 through which air may pass. The number of holes at 216 as compared to the number of holes at 206 determines the proportion of the air flow split. A first portion 220 of the air flows directly onto the back of the control panel 204. The second portion of the air flows over the top of the panel 214 and down over the controls 200–203. Fresh air 224 may also flow in from the front, over the top of control panel 204, further cooling the controls. Hence, the controls are at all times bathed by a cooling stream of ambient air which has just been drawn into the oven.

Regardless of its source, the air flowing downwardly over the controls becomes the combustion air for the inshot burners 26–30, as indicated by the arrow 226. Once the combustion air reaches the inshot burners 26–30, the remainder of the air flow through the oven is as shown in FIG. 8 and as described above.

Those who are skilled in the art will readily perceive how to modify the invention. Therefore, the appended claims are to be construed to cover all equivalent structures which fall within the true scope and spirit of the invention.

The claimed invention is:

1. A low profile commercial restaurant type of convection oven comprising an insulated housing having a baking cavity with ceiling, floor, and sides, access doors on one side of said cavity, a blower or impeller on another side of said cavity, a first horizontal channel formed under a floor of said oven cavity, a second horizontal channel formed over a ceiling of said baking cavity, each of said channels having an opening to receive incoming combustion air for drawing air into and expelling air from said oven cavity via a predetermined path, inshot burner means near but outside the front of said oven and at said opening in said first channel, said blower or impeller drawing in combustion air past said inshot burner means and expelling air heated by said burner means into said oven cavity, and oven controls, said combustion air drawn by said blower being cool ambient external air drawn over said oven controls while said combustion air is still cool and before it is heated by said burner means, thereby cooling said controls.

2. The oven of claim 1 wherein said combustion air is cool ambient external air drawn in at the front of the oven.

3. The oven of claim 1 wherein said combustion air is cool ambient external air drawn in at the back of the oven.

4. The oven in claim 1 wherein said blower or impeller means comprises a rotating cylinder with a solid plate in a central axial region thereof and with blades on one side of said solid plate for drawing ambient external air past said burner means and into said oven, and with blades on the other side of said solid plate for circulating air within the oven and for expelling said air from said oven.

5. The oven of claim 4 and baffle means for separating said baking cavity into two compartments, one of said compartments containing said blower means, the other of said compartments forming a baking area, said baffle including a first opening for passage of air from an interior of said oven into a center of said blower, there being an opening surrounding said baffle means through which said circulating air is expelled from said blower and into the oven.

6. The oven of claim 1 wherein said inshot burner means further comprises a plurality of modular somewhat cylindrical units which clip together to form an aligned array of burners, means for feeding gas into one end of each of said somewhat cylindrical unit, and flame shaping means at an other end of said cylindrical unit for projecting a flame into said first channel.

7. The oven of claim 6 wherein said array of burner means are oriented in a horizontal row with said somewhat cylindrical units projecting forwardly so that a plurality of flames are horizontally projected into said first channels.

8. A low profile convection oven comprising an insulated housing enclosure having controls thereon, means for drawing in cool air and for directing said cool air over said controls, a central baking area defined on two oppositely disposed sides by non-insulated walls, channels forming air passageways on said at least two sides, said channels being outside of said non-insulated walls, heater means at the entrance of one of said channels for heating said drawn in air, blower means for drawing said cool air through one of said channels past said heater means and blowing the heated air out the other of said channels while circulating said air within said oven, and whereby said one channel does not have to be large enough to contain said heating means.

9. The oven of claim 8 wherein said channels are above and below the baking area, said one channel extending across substantially the full width of said oven, and said heater means comprise a plurality of gas jets distributed in a row across the width of said oven and positioned to drive flames into said one channel.

10. A low profile convection oven comprising an insulated housing enclosure having controls thereon, means for drawing in cool air and for first directing said cool air over said controls and then directing said air to support combustion, a central baking area defined on two oppositely disposed sides by non-insulated walls, channels forming air passageways on said at least two sides, said channels being outside of said non-insulated walls, said channels being above and below the baking area, heater means at the entrance of one of said channels for using said air that supports combustion for heating said drawn in air, blower means for drawing said cool air both over said controls and through one of said channels past said heater means circulating said air within said oven, and blowing the heated air out the other of said channels, said one channel extending across substantially the full width of said oven, and said heater means comprise a plurality of gas jet burners distributed in a row across the width of said oven and positioned to drive flames into said one channel, whereby said one channel does not have to be large enough to contain said heating means, said blower means including two sets of blades, one set of blades drawing said air into said one channel and out into the baking area, the other set of said blades circulating said air within said baking area and driving the air out through said other channel.

11. The oven of claim 10 wherein said heater means is at a front of said oven for easy maintenance.

12. A low profile convection oven comprising an insulated housing enclosure having controls thereon, air intake openings in the back of said oven, a duct for conveying cool air entering said intake openings to said controls, blower means for drawing in cool air via said intake openings and said duct and for directing said cool air over said controls, means in said duct for splitting said conveyed air in order to bathe said controls by said cool air engaging said controls from different directions, a central baking area within said enclosure and defined on two oppositely disposed upper and lower sides by non-insulated walls, channels above and below the baking area forming air passageways on said two sides, said channels being outside of said non-insulated walls, heater means at the entrance of one of said channels for heating said drawn in air, said blower means drawing sais cool air through said duct and said one of said channels past said heater means circulating air heated by said heater means within said oven, and blowing the heated air out the other of said channels, said one channel extending across substantially the full width of said oven, and said heater means comprise a plurality of gas jet burners distributed in a row across the width of said oven and positioned to drive flames into said one channel, whereby said one channel does not have to be large enough to contain said heating means.

13. A plurality of stackable, low profile convection ovens, each of said ovens comprising a baking cavity with air channel means for continuously delivering ambient external air into and exhausting hot air from said cavity; inshot burner means using said continuously delivered ambient external air for heating air at an entrance of one of said air channels, whereby the overall height of said oven is reduced since said burner means is not enclosed within a space below said cavity; blower means for continuously drawing said delivered ambient air past said burner means for sustaining combustion therein, under said lower cavity wall, circulating air within said cavity, blowing air over said upper cavity wall and out of said oven; and means for enclosing said cavity and air channel means within insulated cavity walls.

14. A plurality of stackable, low profile convection ovens, each of said ovens comprising a baking cavity with air channel means for delivering ambient external air into and exhausting hot air from said cavity; combustion burner means for heating air at an entrance of one of said air channels, whereby the overall height of said oven is reduced since said burner means is not enclosed within a space below said cavity; blower means for drawing air past said burner means, under said lower cavity wall, circulating air within said cavity, blowing air over said upper cavity wall and out of said oven; and means for enclosing said cavity and air channel means within insulated cavity walls, controls for said oven mounted near said baking cavity; ambient external air intake openings in the back of said oven; a duct for conveying said ambient external air under the driving of said blower means from said air intake openings to cool said controls for said oven and then on to support combustion in said burner means; and means in said duct for splitting said cooling air in order to bathe said controls by said cool air from different directions.

15. The oven of claim 14 and means for directing said cooling air after bathing said controls into said burner means.

* * * * *